US006881090B1

(12) United States Patent
Bohn

(10) Patent No.: US 6,881,090 B1
(45) Date of Patent: Apr. 19, 2005

(54) ROTATABLE NO STRIP NO CRIMP ELECTRICAL CONNECTOR FOR WIRES

(75) Inventor: Zachory Bohn, Chalfont, PA (US)

(73) Assignee: R & B Inc., Colmar, PA (US)

( * ) Notice: Subject to any disclaimer, the term of this patent is extended or adjusted under 35 U.S.C. 154(b) by 0 days.

(21) Appl. No.: 10/703,934

(22) Filed: Nov. 7, 2003

(51) Int. Cl.[7] ..... H01R 11/20
(52) U.S. Cl. ..... 439/402
(58) Field of Search ..... 439/402, 403, 439/409, 410, 413, 796, 725

(56) References Cited

U.S. PATENT DOCUMENTS 2,725,545 A * 11/1955 Gordon ..... 439/413
2,999,223 A * 9/1961 Peter ..... 439/724
5,228,875 A 7/1993 Swenson, Sr.
5,254,015 A * 10/1993 Robertson ..... 439/410
5,695,369 A 12/1997 Swenson, Sr.
5,868,589 A 2/1999 Swenson, Sr.
5,961,342 A * 10/1999 Daoud ..... 439/403
6,358,103 B1 3/2002 Tomasino

* cited by examiner

*Primary Examiner*—Phuong Dinh
(74) *Attorney, Agent, or Firm*—Volpe and Koenig, P.C.

(57) ABSTRACT

An electrical connector has a first wire receiver having a hole therethrough for receiving a first wire, a second wire receiver having a hole therethrough for receiving a second wire, and an intermediate connector, positioned between the first wire receiver and the second wire receiver with a conductive connection between first and second conductive blades.

12 Claims, 4 Drawing Sheets

FIG. 3
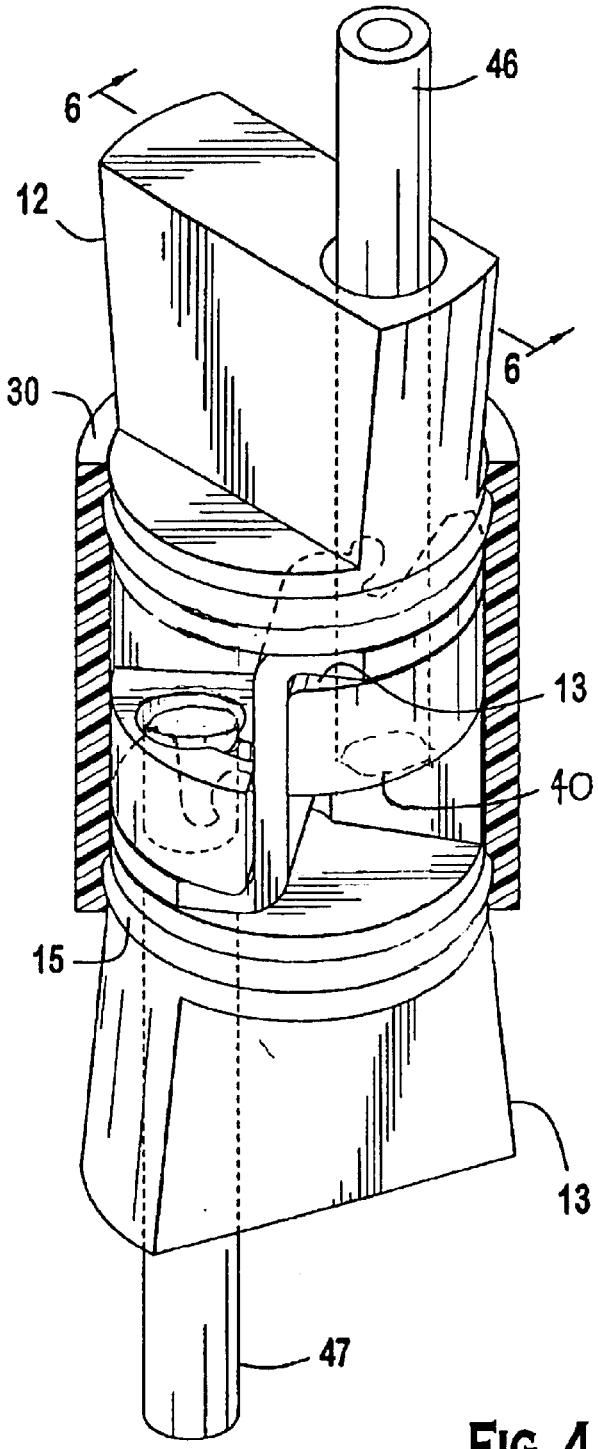
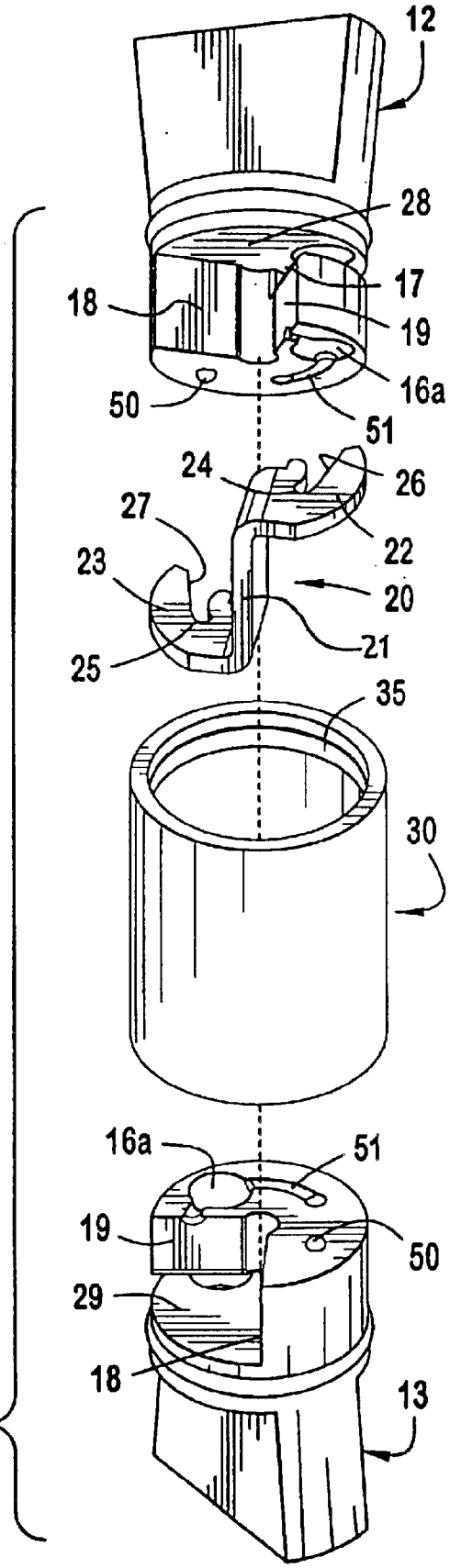
FIG. 4

ROTATABLE NO STRIP NO CRIMP ELECTRICAL CONNECTOR FOR WIRES

BACKGROUND

Joining electrical wires can be done in many ways, but most involve one of two methods. The first is the traditional twist connection, wherein two wire ends are stripped of their protective insulation, twisted around each other and insulated using some form of post joining insulation, such as electrical tape or a wire nut. This method is usually effective for making an electrical connection that will not be touched, but is often not as adequate for joining wires together securely enough to prevent separation. The second method involves stripping two wires and joining them within a housing by means of a locking mechanism in the housing. These housings come in several varieties such as those shown in U.S. Pat. Nos. 5,228,875 and 6,358,103. The disadvantage of each of these connections and the connectors is that they still entail the time consuming step of stripping the wire. This step not only takes time, but it may damage the wire, and can also be difficult to perform when working in a confined space. Furthermore, the housings shown in these patents require disassembly before the electrical connection is made. A need exists for an electrical connector that avoids wire stripping and disassembly of the connector.

SUMMARY

An electrical connector that addresses these needs has a first wire receiver having a hole therethrough for receiving a first wire, a second wire receiver having a hole therethrough for receiving a second wire, and an intermediate connector, positioned between the first wire receiver and the second wire receiver with a conductive connection between first and second conductive blades.

BRIEF DESCRIPTION OF THE DRAWING(S)

FIG. 3 is a partial cross-section of the electrical connector of the invention with wires inserted and engaged.

FIG. 4 is an exploded perspective view of the electrical connector of the invention showing its component parts.

DETAILED DESCRIPTION OF THE PREFERRED EMBODIMENT(S)

In the Figures, like numerals indicate like parts of the electrical connector 10. The connector 10 preferably comprises four separate parts: two wire receivers 12 and a connector 20, and a sleeve 30. Before describing each of these in detail, the joining of two wires using the connector 10 will be described.

Figure 1:
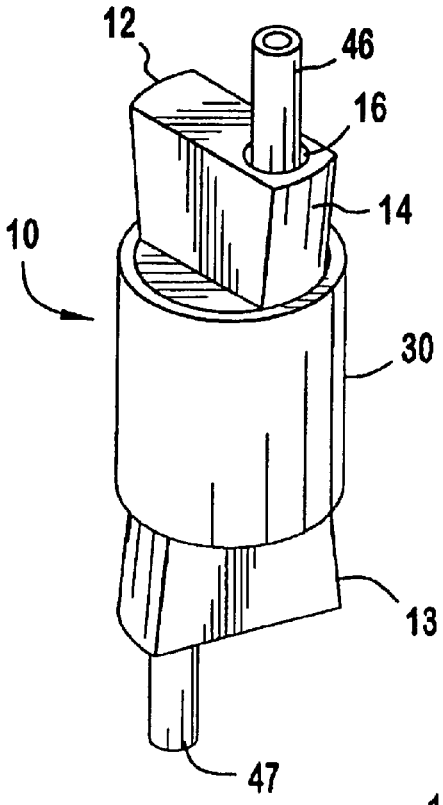
FIG. 1 is a perspective view of the electrical connector of the invention.
Figure 2:
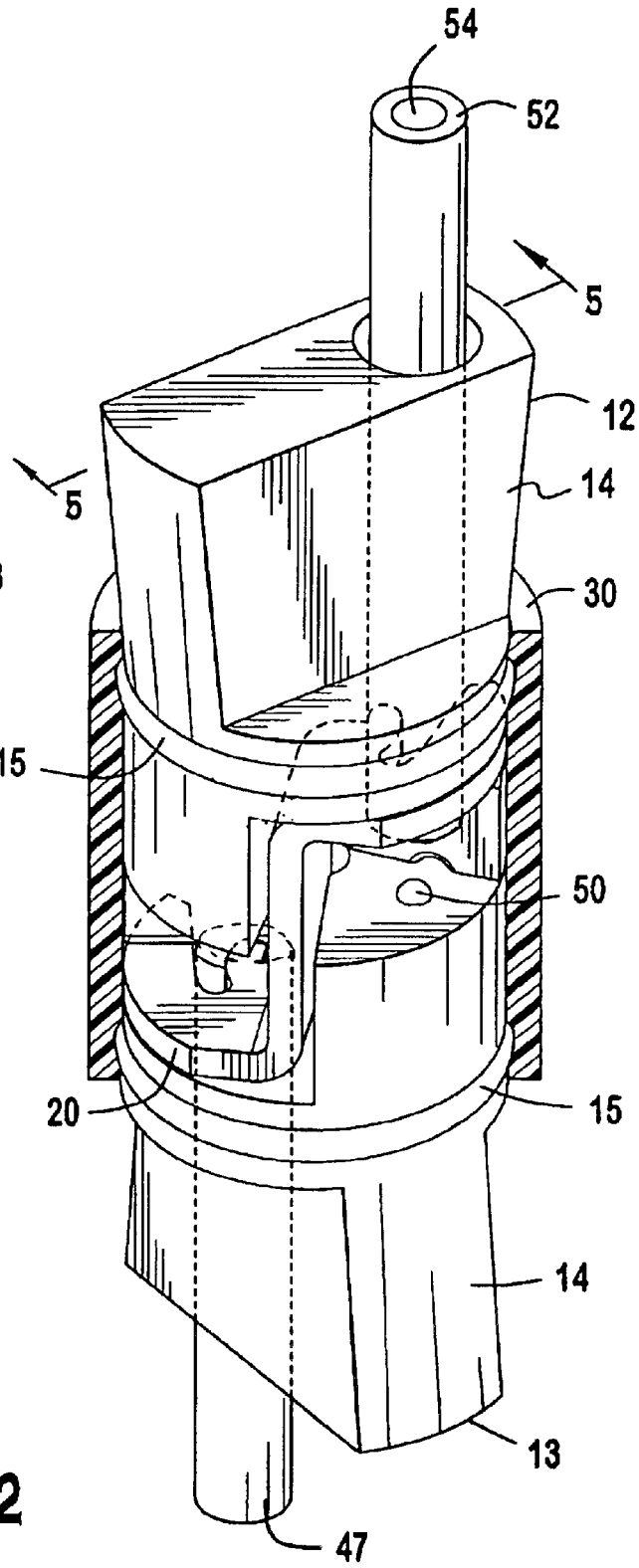
FIG. 2 is a partial cross-section of an electrical connector of the invention with wire inserted but not engaged.
Figure 5:
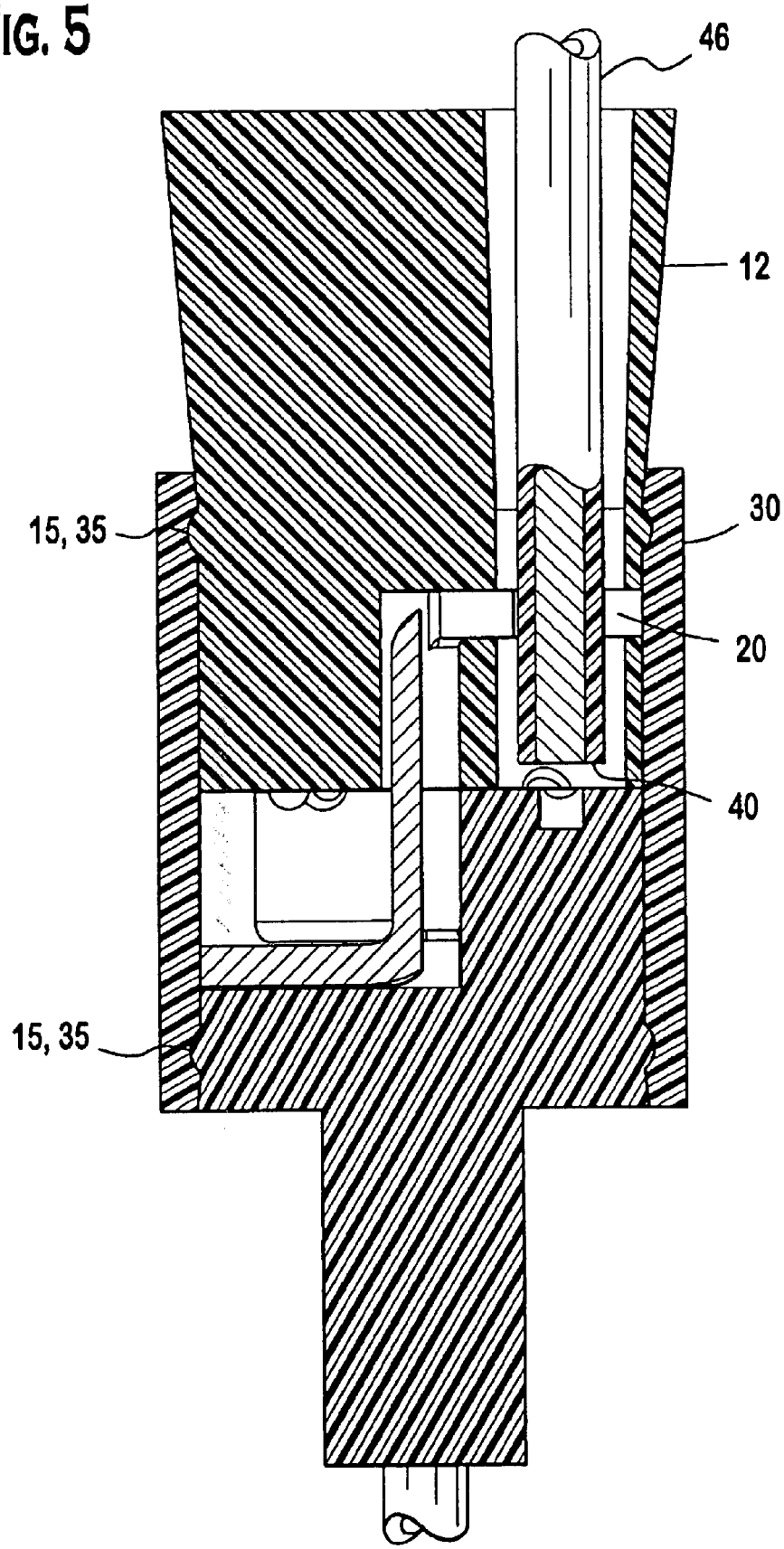
FIG. 5 is a cross-section through the line 5—5 in FIG. 2.

With the connector 10 fully assembled (FIG. 1), each of the wire receivers 12 and 13 is rotated until its stop 18 contacts the intermediate connector 20 as shown in FIGS. 2 and 5. At this point, the first and second holes 16, 17 align with respective blade 22 or 23 of the intermediate connector 20. With the receivers so aligned, wires 46 and 47 are inserted into the first and second holes, preferably until they contact wire stops 28 and 29. When the wires 46 and 47 are initially inserted the widest portion 26, 27 of the tapered notches on the blade 22, 23 generally do not contact conductive element 40 of the wire, see FIG. 5.

Figure 6:
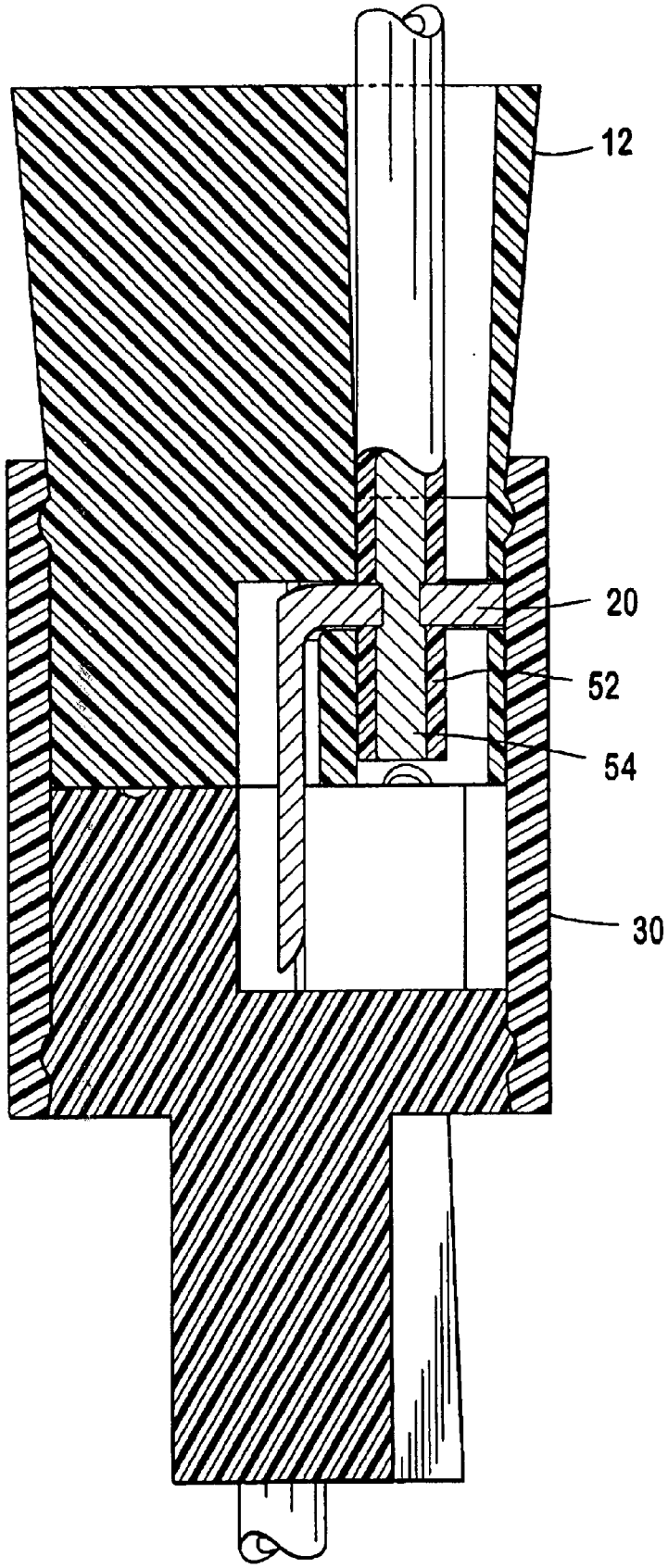
FIG. 6 is a cross-section through the line 6—6 in FIG. 3.

With the wires in the connector 10 as described above, the wire receivers 12, 13 are both rotated and the blades 22, 23 are engaged with the wires 46, 47 until the friction between the narrow portion 24, 25 of is too great to overcome, or until the respective second stop 19 contacts' the intermediate connector 20 as shown in FIGS. 3 and 6. During this rotation, the blades 22, 23 pierce the wire insulation and the intermediate connector 20 establishes a conductive connection between the wires 46, 47, and prevents them from being easily pulled from the connector. This connection bypasses the step of wire stripping while providing a secure and insulated connection.

Each of the parts of the connector 10 will now be described in detail. As shown in FIGS. 2–4, the wire receivers 12, 13 are identical parts, preferably molded, of a non-conductive material such as rubber, polyvinyl chloride, nylon, or other dielectric material. The hole 16 extends from the extension 14, which serves as a gripping point, through the receiver 12 to the exit end 16*a* on the inner portion of the receiver 12. The receiver 12 has an external annular ring 15, see FIG. 2 or 4 that protrudes from its surface and mates with an internal annular groove in the sleeve, as will be described later. The receiver 12 also has a recess 17, see FIG. 4, for receiving a blade 22 from connector 20 when the receiver 12 is rotated to secure a wire 46.

The connector 20 is preferably formed as a single unit and has a intermediate conductive connection along the body 21 that connects the two conductive blades 22, 23. The blades 22 and 23 face the same directions and are horizontally disposed with reference to the vertically oriented conductive body 21.

The tapered blades 22, 23 preferably make use of pressure to pierce through wire insulation and establish the electrical connection. In most applications, the blades do not need to be sharp or serrated because the pressure applied to the insulation as the wire moves into the tapered notch is sufficient to displace the insulation and establish a connection between the blade and the wire.

The sleeve 30 is generally cylindrical and also is made of non-conductive material. The sleeve's diameter is larger than the diameter of the receivers 12, 13, to allow them to rotate. The two interior grooves 35, see FIG. 4, matingly receive the ring 15 on each receiver. This mated engagement provides a continuous insulation from receiver 12 to receiver 13. This mated engagement also retains the separate parts of the receivers 12, 13 and the intermediate connector 20 assembled together. Alignment of the receivers 12, 13 is also helped by the rounded protrusion 50 and its mating groove 51 contained within each receiver. These mated parts 50, 51 guide the receivers 12, 13 (and wire) when the receivers are turned, and help to hold the wire receivers 12,13 and intermediate connector 20 firmly within the sleeve 30.

To assemble the connector 10, the receivers 12, 13 and intermediate connector 20 are aligned as they would be inside the sleeve, and then are pushed into the sleeve until a snap fit it is achieved between the rings 15 and the grooves 35. Alternatively, the receivers 12, 13 and the intermediate connector 20 are assembled and the sleeve is wrapped around this sub-assembly and sealed closed, such as by plastic weld, snapped closed, or firmly closed in another manner such as controlled heat shrinking. Since substantial force is required to remove the receivers 12, 13 and intermediate connector 20 from the sleeve 30, inadvertent removal is not likely.

What is claimed is:

1. An electrical connector comprising:

a first wire receiver for receiving a first wire;

a second wire receiver for receiving a second wire;

an intermediate connector positioned between the first wire receiver and the second wire receiver and having electrically connected first and second blades that are horizontally disposed on opposite sides of a vertical plane and capable of establishing a conductive connection with a respective wire; and a non-conductive sleeve which retains the wire receivers relative to each other so that a respective conductive blade is located adjacent a respective wire and the wire receivers are rotatable within the sleeve.

2. The connector of claim 1 wherein the blades are oriented in a common direction.

3. The connector of claim 1 wherein the vertical plane is defined the electrical connection between the blades.

4. The connector of claim 1 wherein the blades and the conductive connection are formed as a single unit.

5. The electrical connector of claim 1 wherein the first blade secures the first electrical wire when the first receiver is turned about an axis through the first receiver and the second blade secures the second electrical wire when the second receiver is turned about an axis through the second receiver.

6. The electrical connector of claim 1 wherein the non-conductive sleeve covers the connector and portions of the first receiver and second receiver.

7. The electrical connector of claim 6 wherein the first receiver, second receiver, connector, and sleeve are connected together in a slidable fit within the sleeve.

8. The electrical connector of claim 1 wherein the first receiver, second receiver, and connector are connected together in a slidable fit.

9. The electrical connector of claim 1 wherein the first blade and second blade comprise a V-shaped notch.

10. The electrical connector of claim 6 wherein the first receiver and the second receiver each matingly engage the sleeve.

11. The electrical connector of claim 10 wherein the mating engagement is achieved by a protruding ring on the first receiver, a protruding ring on the second receiver and a corresponding first groove and second groove in the sleeve.

12. An electrical connector comprising:

a first wire receiver for receiving a first wire;

a second wire receiver for receiving a second wire;

an intermediate connector positioned between the first wire receiver and the second wire receiver and having electrically connected first and second blades that are horizontally disposed in a common direction on opposite sides of a vertical plane that is defined by the electrical connection between the blades, and each of the blades is capable of establishing a conductive connection with a respective wire; and a non-conductive sleeve which retains the wire receivers relative to each other so that a respective conductive blade is located adjacent a respective wire and the wire receivers are rotatable within the sleeve.

* * * * *

UNITED STATES PATENT AND TRADEMARK OFFICE

CERTIFICATE OF CORRECTION

PATENT NO. : 6,881,090 B1
DATED : April 19, 2005
INVENTOR(S) : Zachory Bohn

It is certified that error appears in the above-identified patent and that said Letters Patent is hereby corrected as shown below:

Column 3,
Line 21, after "defined", insert -- by --.

Signed and Sealed this

Twenty-fourth Day of January, 2006

JON W. DUDAS
*Director of the United States Patent and Trademark Office*